US011506428B2

(12) United States Patent
Ahmed

(10) Patent No.: US 11,506,428 B2
(45) Date of Patent: Nov. 22, 2022

(54) PORTABLE LIQUID PUMP WITH INTEGRATED CHILLER AND HEATER

(71) Applicant: Faizan Ahmed, San Jose, CA (US)

(72) Inventor: Faizan Ahmed, San Jose, CA (US)

( * ) Notice: Subject to any disclaimer, the term of this patent is extended or adjusted under 35 U.S.C. 154(b) by 380 days.

(21) Appl. No.: 16/787,738

(22) Filed: Feb. 11, 2020

(65) Prior Publication Data

US 2020/0173698 A1 Jun. 4, 2020

Related U.S. Application Data

(63) Continuation-in-part of application No. 16/584,761, filed on Sep. 26, 2019.

(60) Provisional application No. 62/772,094, filed on Nov. 28, 2018.

(51) Int. Cl.
*F25B 21/04* (2006.01)
*F25B 21/02* (2006.01)

(52) U.S. Cl.
CPC ..... *F25B 21/04* (2013.01); *F25B 21/02* (2013.01); *F25B 2321/02* (2013.01); *F25B 2321/025* (2013.01)

(58) Field of Classification Search
CPC ..... F25B 21/04; F25B 21/02; F25B 2321/02; F25B 2321/025
See application file for complete search history.

(56) References Cited

U.S. PATENT DOCUMENTS

| | | | | |
|---|---|---|---|---|
| 3,713,302 | A * | 1/1973 | Reviel | F25B 21/02 62/3.62 |
| 6,701,719 | B1 * | 3/2004 | Lee | F25B 21/02 62/3.5 |
| 2006/0075758 | A1 * | 4/2006 | Rice | F25B 21/04 62/434 |
| 2007/0034356 | A1 * | 2/2007 | Kenny | F28D 15/0266 257/E23.098 |
| 2008/0184710 | A1 * | 8/2008 | DeVilbiss | F25B 21/02 62/3.2 |
| 2017/0276409 | A1 * | 9/2017 | Kantor | B65D 81/24 |
| 2018/0098903 | A1 * | 4/2018 | Vergara | H01L 35/30 |
| 2019/0128589 | A1 * | 5/2019 | Adams | F25D 11/003 |

* cited by examiner

*Primary Examiner* — David J Teitelbaum

(57) ABSTRACT

In one aspect, a portable liquid pump with integrated chiller and heater system includes a pump component includes a pump, a liquid chamber, an inlet port and an outlet port. The pump component seals a liquid so that it does not escape except by the inlet port and the exit port. The pump component pressurizes and directs the liquid in a warm state from the inlet port over a Thermo-electric element-based cold-side heat exchanger and through the outlet port. A Thermo-electric element component includes the Thermo-electric element-based cold-side heat exchanger and a hot-side heat exchanger, wherein the Thermo-electric element component converts an electrical current into a temperature difference that in turn causes heat to flow from the Thermo-electric element-based cold-side heat exchanger to the hot-side heat exchanger. A battery component includes an electrical energy storage component that provides electrical power to the Thermo-electric element component that in turn pumps heat from the Thermo-electric element-based cold-side heat exchanger to the hot-side heat exchanger.

5 Claims, 4 Drawing Sheets

PORTABLE LIQUID PUMP WITH INTEGRATED CHILLER AND HEATER

CLAIM OF PRIORITY

This application claims priority to and incorporates by reference U.S. Provisional Application No. 62/772,094, titled THERMO-ELECTRIC COOLER PUMP METHODS AND SYSTEMS, and filed on 28 Nov. 2018.

This application claim priority to U.S. patent application Ser. No. 16/134,192 filed on Sep. 18, 2018. U.S. patent application Ser. No. 16/134,192 claims priority to U.S. patent application Ser. No. 15/939,267 filed on Mar. 28, 2018. U.S. patent application Ser. No. 15/939,267 claims priority to U.S. provisional patent application No. 62/477,598 filed on 28 Mar. 2017. These patent applications are hereby incorporated by reference in its entirety.

BACKGROUND

Field of the Invention

The invention is in the field of refrigeration and more specifically to a method, system and apparatus of a thermo-electric cooler pump.

Description of the Related Art

Medicines and other products can degrade in certain conditions. For example, some temperatures need to be maintained in specified temperature ranges. Patients may not be able to constantly track medicine temperature. The same can be true for some testing instruments such as blood testing strips. Portable refrigerators with can solve these issues. However, effective portable refrigerators need effective components that are sufficiently. Accordingly, improvements to thermo-electric cooler pump design and use are desired.

BRIEF SUMMARY OF THE INVENTION

In one aspect, a portable liquid pump with integrated chiller and heater system includes a pump component includes a pump, a liquid chamber, an inlet port and an outlet port. The pump component seals a liquid so that it does not escape except by the inlet port and the exit port. The pump component pressurizes and directs the liquid in a warm state from the inlet port over a Thermo-electric element-based cold-side heat exchanger and through the outlet port. A Thermo-electric element component includes the Thermo-electric element-based cold-side heat exchanger and a hot-side heat exchanger, wherein the Thermo-electric element component converts an electrical current into a temperature difference that in turn causes heat to flow from the Thermo-electric element-based cold-side heat exchanger to the hot-side heat exchanger. A battery component includes an electrical energy storage component that provides electrical power to the Thermo-electric element component that in turn pumps heat from the Thermo-electric element-based cold-side heat exchanger to the hot-side heat exchanger.

Figure 1:
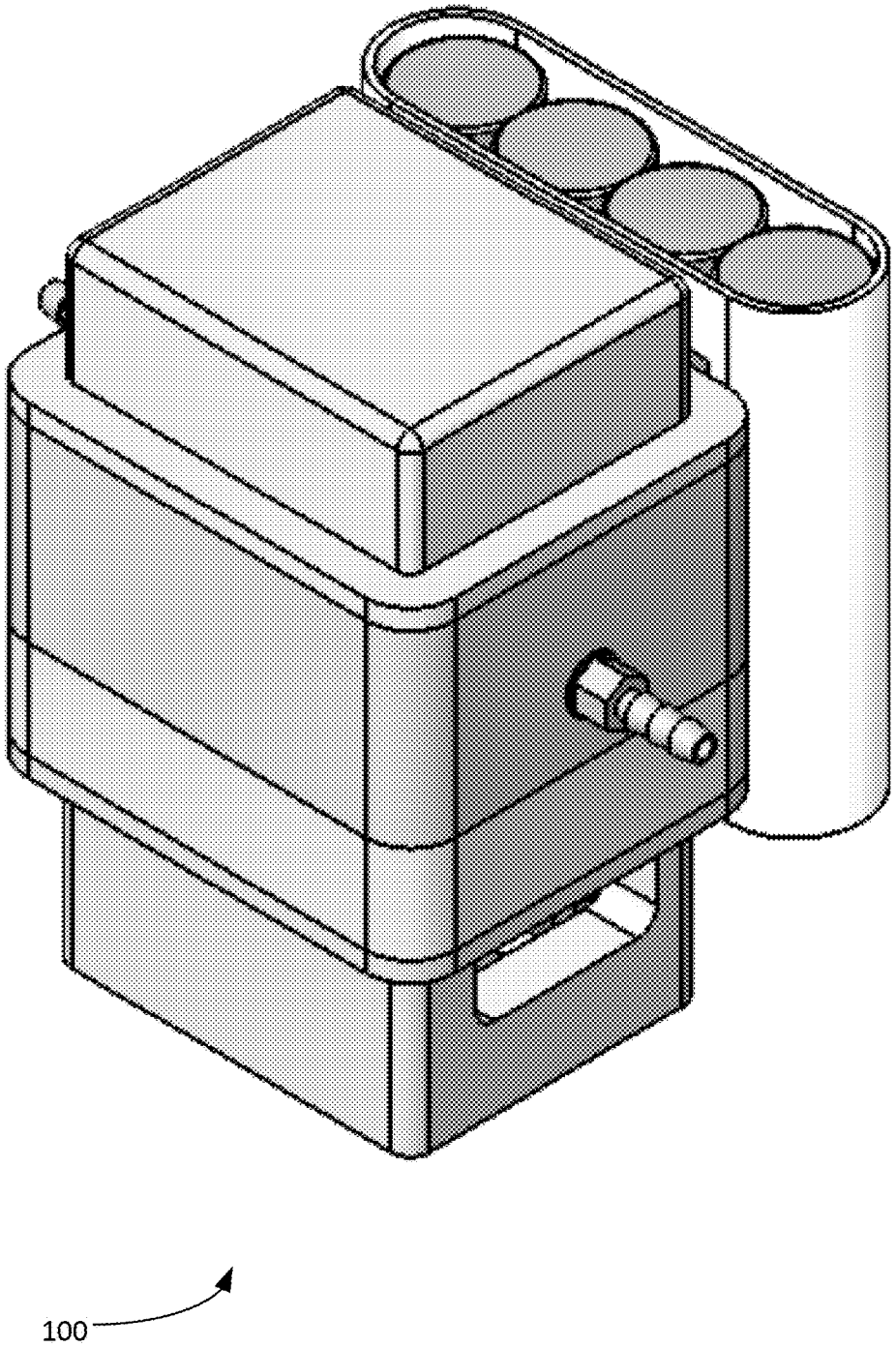
FIG. 1 illustrates an external view of an example portable liquid pump with integrated chiller (and heater), according to some embodiments.

The Figures described above are a representative set and are not an exhaustive with respect to embodying the invention.

DESCRIPTION

Disclosed are a system, method, and article of manufacture for a portable liquid pump with integrated chiller and heater. The following description is presented to enable a person of ordinary skill in the art to make and use the various embodiments. Descriptions of specific devices, techniques, and applications are provided only as examples. Various modifications to the examples described herein can be readily apparent to those of ordinary skill in the art, and the general principles defined herein may be applied to other examples and applications without departing from the spirit and scope of the various embodiments.

Reference throughout this specification to 'one embodiment', 'an embodiment', 'one example', or similar language means that a particular feature, structure, or characteristic described in connection with the embodiment is included in at least one embodiment of the present invention. Thus, appearances of the phrases 'in one embodiment', 'in an embodiment', and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art can recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, and they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Definitions

Example definitions for some embodiments are now provided.

Peltier effect is the presence of heating or cooling at an electrified junction of two different conductors. When a current is made to flow through a junction between two conductors, A and B, heat may be generated or removed at the junction. Thermoelectric cooling uses the Peltier effect to create a heat flux between the junction of two different types of materials. A Peltier cooler, heater, or thermoelectric heat pump is a solid-state active heat pump which transfers heat from one side of the device to the other, with consumption of electrical energy, depending on the direction of the current.

P and N junction can be a boundary or interface between two types of semiconductor materials, p-type and n-type.

Thermoelectric effect is the direct conversion of temperature differences to electric voltage and vice versa via a thermocouple. A thermoelectric device creates voltage when there is a different temperature on each side. Conversely, when a voltage is applied to it, heat is transferred from one side to the other, creating a temperature difference. At the atomic scale, an applied temperature gradient causes charge carriers in the material to diffuse from the hot side to the cold side.

Example Portable Liquid Pump with Integrated Chiller and Heater System

FIG. 1 illustrates an external view of an example portable liquid pump with integrated chiller 100, according to some embodiments.

Figure 2:
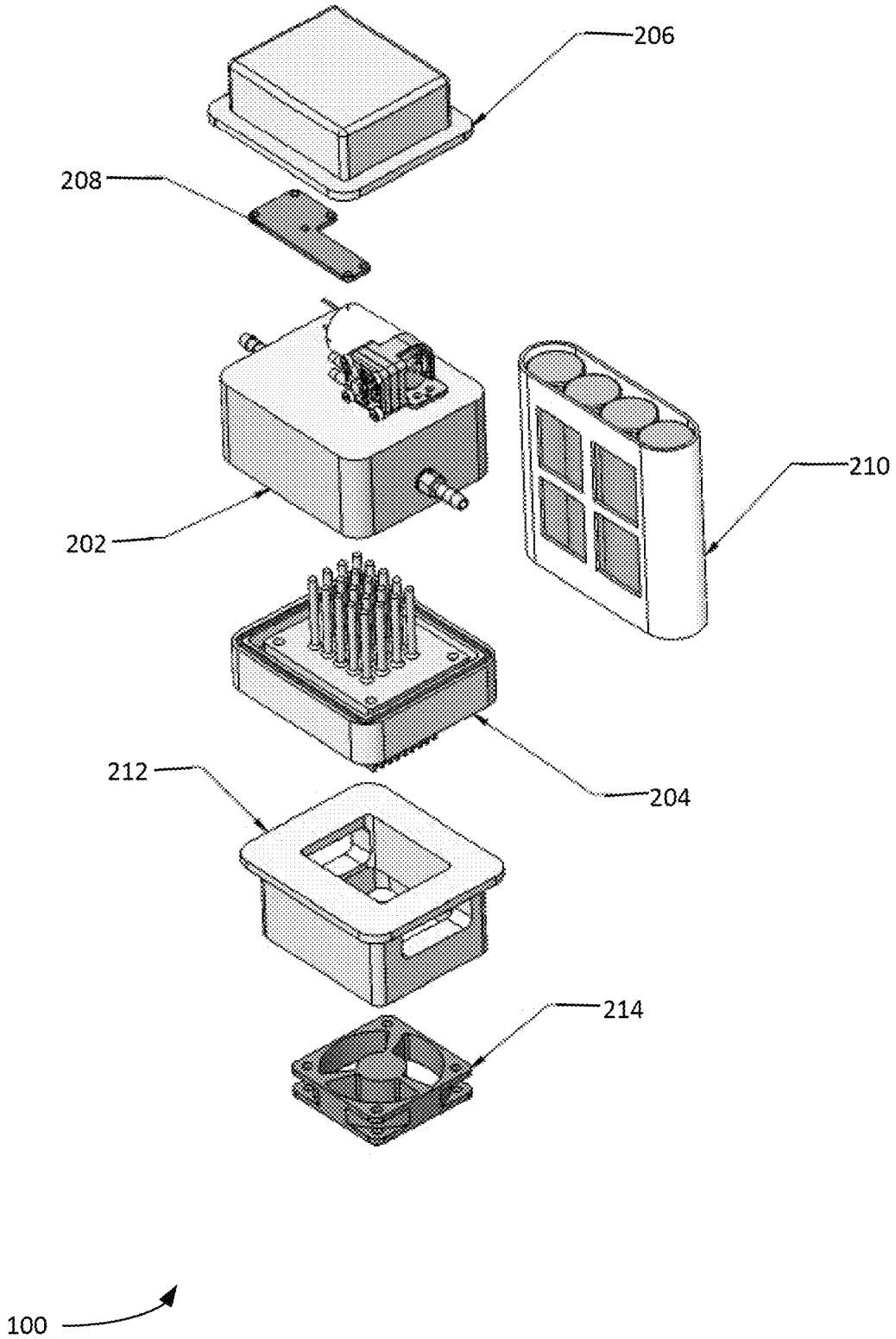
FIG. 2 illustrates an exploded view of an example portable liquid pump with integrated chiller (and heater), according to some embodiments.

FIG. 2 illustrates an exploded view of an example portable liquid pump with integrated chiller (and heater) 100, according to some embodiments. As shown in the exploded view, portable liquid pump with integrated chiller 100 includes three main components: pump component 202, Peltier component 204, and a battery component (e.g. see infra). Portable liquid pump with integrated chiller 100 includes pump component 202. Pump component 202 contains the pump, liquid chamber and inlet and outlet ports. Pump component 202 seals the liquid so that it does not escape except by the inlet port and exit port which are also formed by a case structure. The function of pump component 202 is to pressurize and direct warm fluid. In one example, this fluid can include a water-based anti-freeze and/or other type of anti-freeze fluid. The fluid is pumped from the inlet port over the cold-side heat exchanger and through the outlet port (see FIG. 3 infra). As shown, portable liquid pump with integrated chiller (and heater) 100 also includes, inter alia: lower pump assembly 202; trimmer control PCB assembly 208; battery pack assembly 210; cooling fan mount 212.

Figure 3:
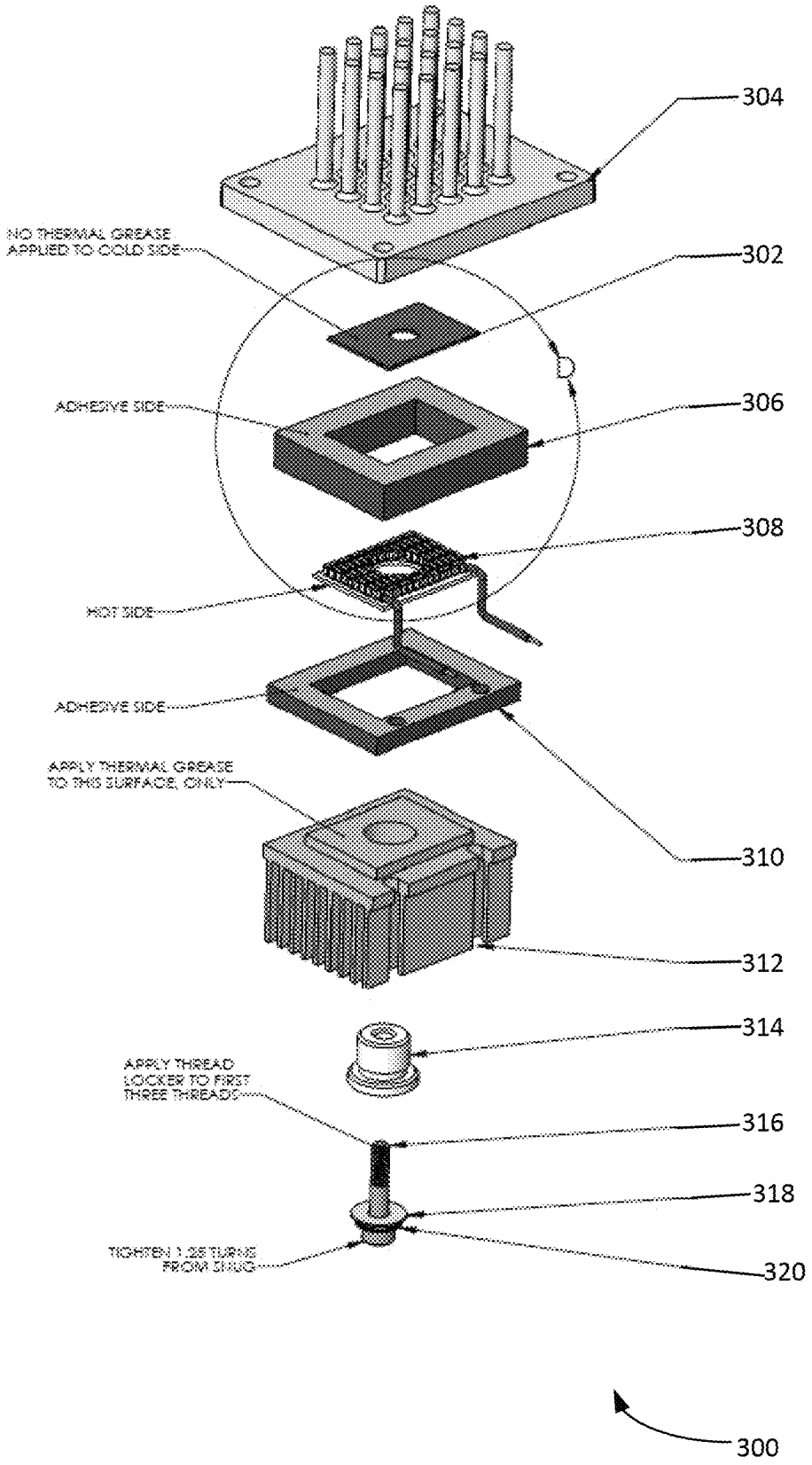
FIG. 3 illustrates an exploded view of Peltier device, according to some embodiments.

FIG. 3 illustrates an exploded view of Peltier device 204, according to some embodiments. As shown, the Peltier device 204 consists of the Peltier-based cold-side heat exchanger and hot-side heat exchanger. The Peltier converts electrical current into a temperature difference that, in turn, causes heat to flow from the cold-side to the hot-side.

The cold-side includes conductive pads 302 attached to P and N Junctions 308 and is an electrical-current carrying component. P and N Junctions 308 are also thermally conductive and are attached directly to the cold-side heat exchanger. The hot-side of the Peltier device 308 includes a ceramic plate. The ceramic plate can be electrically and thermally non-conductive. The ceramic plate can be thin and can conduct heat in sufficient quantities from the junctions to the hot-side heat exchanger.

Peltier device 204 includes additionally components as shown. These can include, inter ilia: plate on top with fins 304, adhesive layer 306, thin insulator, 310, trimmer heat sink, 312, insulating shoulder washer 314, hardened flat washer 316, Milspec 318 disc washer 320, etc.

Returning to FIG. 2, battery pack assembly 210 is an electrical energy storage component that provides electrical power to Peltier device 204. Peltier device 204, in turn, pumps heat from the cold-side to the hot-side.

It is noted that portable liquid pump with integrated chiller (and/or heater) 100 is a portable (e.g. lightweight and small sized) device that is also battery-powered. Portable liquid pump with integrated chiller can mitigate temperature gradients that exist in one or more temperature-controlled sample chambers. Portable liquid pump with integrated chiller 100 can manage the temperature of the sample while it is being transported and is unable to be connect to an energy supply. With the addition of low-powered controls and temperature sensors, portable liquid pump with integrated chiller 100 can actively reduce the temperature gradient, to a preset amount and/or perform data logging. Data logging can be used to verify the sample chamber has been maintained appropriately throughout the transport time.

Appendix A illustrates additional information that can be utilized to implement various example embodiments.

Example Process

Figure 4:
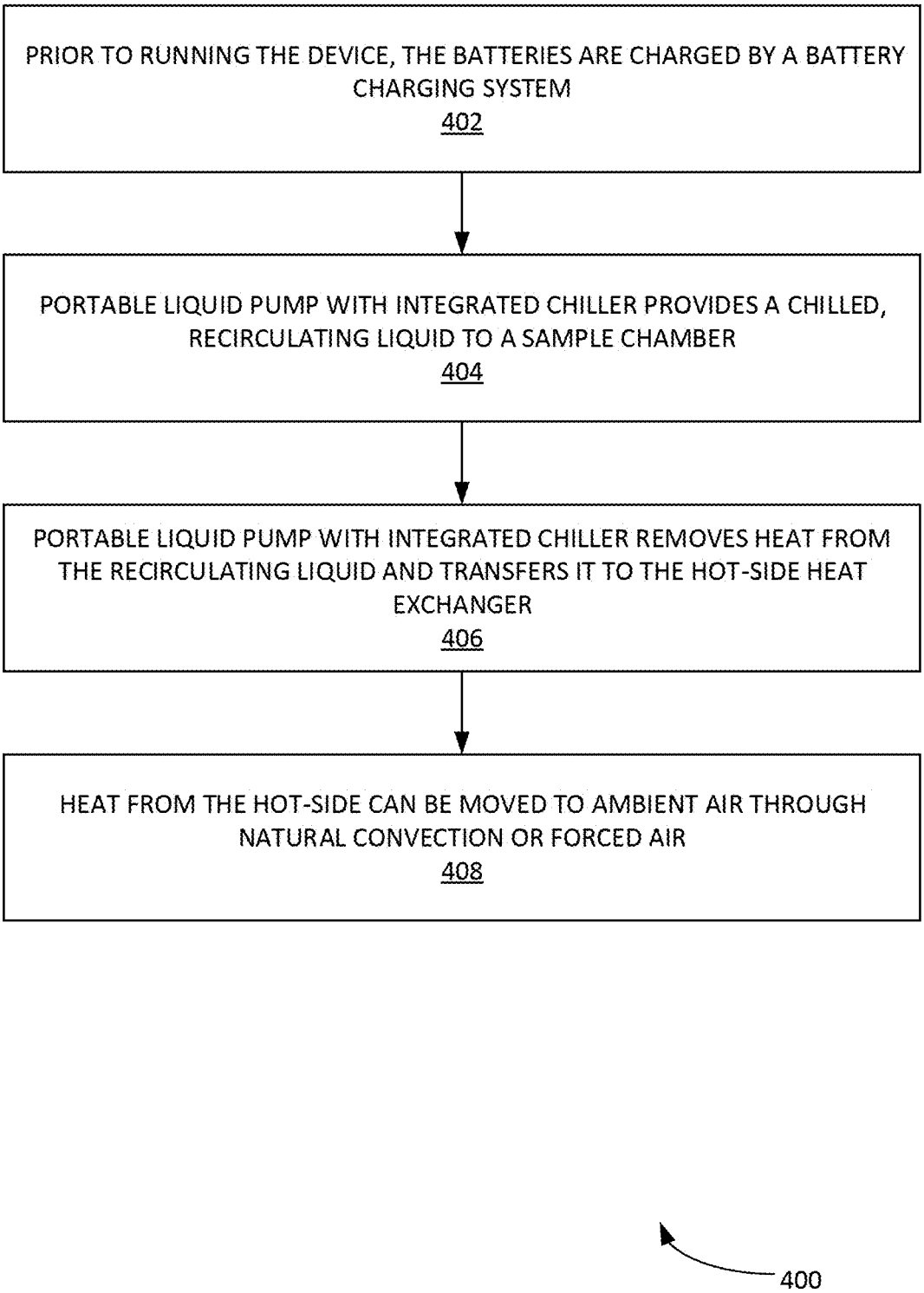
FIG. 4 illustrates an example process for implementing a portable liquid pump with integrated chiller (and heater), according to some embodiments.

FIG. 4 illustrates an example process 400 for implementing a portable liquid pump with integrated chiller, according to some embodiments.

As shown the FIGS. 1-3 and Appendix A, portable liquid pump with integrated chiller has inlet and outlet ports that are connected to a recirculating liquid system. Accordingly, in step 402, prior to running the device, the batteries are charged by a battery charging system. In step 404, portable liquid pump with integrated chiller 100 provides a chilled, recirculating liquid to a sample chamber. The chamber can contain heat sensitive materials, such as drugs or bio-tissue.

In step 406, portable liquid pump with integrated chiller 100 removes heat from the recirculating liquid and transfers it to the hot-side heat exchanger. In step 408, the heat from the hot-side can be moved to ambient air through natural convection and/or forced air (e.g. by fan/cooling fan mount 212, etc.).

It is noted that cooling fan mount 212 can provide chilled liquid to a sample chamber at a slower rate in order to control the temperature gradient in the sample chamber while another device maintains an overall lower temperature in the sample chamber. With the addition of electronic controls, temperature sensors and memory, portable liquid pump with integrated chiller 100 can provide active temperature management and a data logging function to verify the sample chamber is maintained at an approved temperature.

Conclusion

Although the present embodiments have been described with reference to specific example embodiments, various modifications and changes can be made to these embodiments without departing from the broader spirit and scope of the various embodiments. For example, the various devices, modules, etc. described herein can be enabled and operated using hardware circuitry, firmware, software or any combination of hardware, firmware, and software (e.g., embodied in a machine-readable medium).

In addition, it can be appreciated that the various operations, processes, and methods disclosed herein can be embodied in a machine-readable medium and/or a machine accessible medium compatible with a data processing system (e.g., a computer system), and can be performed in any order (e.g., including using means for achieving the various operations). Accordingly, the specification and drawings are to be regarded in an illustrative rather than a restrictive sense. In some embodiments, the machine-readable medium can be a non-transitory form of machine-readable medium.

What is claimed is:

1. A portable liquid pump with integrated chiller and heater system comprising:

a pump component comprising a pump, a liquid chamber, an inlet port and an outlet port, wherein the pump component seals a liquid so that it does not escape except by the inlet port and the exit port, wherein the pump component pressurizes and directs the liquid in a warm state from the inlet port over a Thermo-electric element-based cold-side heat exchanger and through the outlet port;

a Thermo-electric element component comprises the Thermo-electric element-based cold-side heat exchanger and a Thermo-electric element-based hot-side heat exchanger, wherein the thermo-electric element component converts an electrical current into a temperature difference that in turn causes heat to flow from the cold-side heat exchanger to the hot-side heat exchanger;

a battery component comprising an electrical energy storage component that provides electrical power to the thermo-electric element component that in turn pumps heat from the cold-side heat exchanger to the hot-side heat exchanger, a cooling fan mount coupled with the Thermo-electric element component, and wherein the inlet port and the outlet port are formed by a case, wherein the liquid comprises a water-based anti-freeze liquid, wherein the hot-side heat exchanger of the thermo-electric element component comprises a ceramic plate that is electrically non-conductive, wherein the ceramic plate is of a specified thinness such that the ceramic plate conducts heat in sufficient quantities from the N and P Junctions to the hot-side heat exchanger, wherein the portable liquid pump is integrated inside a temperature-controlled sample chamber, wherein the portable liquid pump is integrated inside a temperature-controlled sample chamber of a portable refrigerator, wherein the cooling fan mount provides chilled liquid to the sample chamber at a slower rate in order to control the temperature gradient in the sample chamber while another cooling system maintains an overall lower temperature in the sample chamber.

2. A method of an operating a portable liquid pump with integrated chiller and heater system comprising:

a portable liquid pump with integrated chiller and heater system, wherein the portable liquid pump comprises:

a pump component comprising a pump, a liquid chamber, an inlet port and an outlet port, wherein the pump component seals a liquid so that it does not escape except by the inlet port and the exit port, wherein the pump component pressurizes and directs the liquid in a warm state from the inlet port over a Thermo-electric element-based cold-side heat exchanger and through the outlet port, a Thermo-electric element component comprises the Thermo-electric element-based cold-side heat exchanger and a Thermo-electric element-based hot-side heat exchanger, wherein the Thermo-electric element component converts an electrical current into a temperature difference that in turn causes heat to flow from the cold-side heat exchanger to the hot-side heat exchanger, and a battery component comprising an electrical energy storage component that provides electrical power to the Thermo-electric element component that in turn pumps heat from the cold-side heat exchanger to the hot-side heat exchanger;

prior to running the portable liquid pump, the batteries are charged by a battery charging system;

with the portable liquid pump, providing a chilled and recirculating liquid to a sample chamber of portable medical storage system;

with the portable liquid pump, removing heat from a recirculating liquid and transfers the heat to the hot-side heat exchanger, and with a fan and cooling fan mount coupled with the Thermo-electric element component, providing the chilled and recirculating liquid to the sample chamber at a slower rate in order to control the temperature gradient in the sample chamber while another cooling system maintains an overall lower temperature in the sample chamber, and wherein the heat from the hot-side heat exchanger is moved to an ambient air through a forced air operation by the fan.

3. The method of claim 2, wherein the sample chamber includes one or more heat sensitive materials.

4. The method of claim 3, wherein the one or more heat sensitive materials comprises a medical drug or bio-tissue.

5. The method of claim 4, wherein the heat from the hot-side heat exchanger is moved to an ambient air through a natural convection operation.

* * * * *